US012384642B2

(12) United States Patent
Matsuyama

(10) Patent No.: US 12,384,642 B2
(45) Date of Patent: Aug. 12, 2025

(54) MEDIUM CONVEYING APPARATUS AND IMAGE FORMING APPARATUS

(71) Applicant: KYOCERA Document Solutions Inc., Osaka (JP)

(72) Inventor: Ryo Matsuyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 215 days.

(21) Appl. No.: 18/360,566

(22) Filed: Jul. 27, 2023

(65) Prior Publication Data

US 2024/0034582 A1 Feb. 1, 2024

(30) Foreign Application Priority Data

Jul. 29, 2022 (JP) ..... 2022-121498

(51) Int. Cl.
*B65H 29/12* (2006.01)

(52) U.S. Cl.
CPC ..... *B65H 29/12* (2013.01); *B65H 2404/1115* (2013.01); *B65H 2404/1313* (2013.01); *B65H 2404/1316* (2013.01); *B65H 2404/1321* (2013.01)

(58) Field of Classification Search
CPC ..... B65H 29/12; B65H 2404/1115; B65H 2404/1313; B65H 2404/1316
See application file for complete search history.

(56) References Cited

U.S. PATENT DOCUMENTS 7,661,674 B2 * 2/2010 Izuchi ..... B65H 29/70 271/274
9,845,211 B1 * 12/2017 Park ..... B65H 3/5215
2006/0139430 A1 * 6/2006 Izuchi ..... B41J 13/076 400/636
2010/0140862 A1 * 6/2010 Yamaguchi ..... B65H 29/125 271/10.11

FOREIGN PATENT DOCUMENTS

JP 2006182482 A 7/2006

* cited by examiner

*Primary Examiner* — Patrick Cicchino
(74) *Attorney, Agent, or Firm* — Alleman Hall & Tuttle LLP

(57) ABSTRACT

A medium conveying apparatus includes a drive roller, a driven roller, and a supporting portion. The drive roller includes a drive body portion and a drive contact portion. The drive contact portion is formed of a material having a smaller friction coefficient or a higher surface hardness than the drive body portion, and is formed with a groove portion along a circumferential direction. The driven roller includes a driven contact portion which comes into contact with the drive contact portion at a non-conveying position, and a plurality of protrusion portions which protrude outwardly in a radial direction. The plurality of protrusion portions are arranged in the groove portion at the non-conveying position. The drive contact portion is formed with a pair of guide portions which guide, to the groove portion, the protrusion portions of the driven roller moving from a conveying position to the non-conveying position.

4 Claims, 12 Drawing Sheets

MEDIUM CONVEYING APPARATUS AND IMAGE FORMING APPARATUS

INCORPORATION BY REFERENCE

This application is based upon and claims the benefit of priority from the corresponding Japanese Patent Application No. 2022-121498 filed on Jul. 29, 2022, the entire contents of which are incorporated herein by reference.

BACKGROUND

The present disclosure relates to a medium conveying apparatus and an image forming apparatus.

There is known a conveying apparatus which conveys a sheet while nipping the sheet by a pair of rollers. For example, this conveying apparatus includes a gear roller, a sheet discharge roller, and an elastic shaft.

The gear roller includes an intermediate hub portion and a pair of gears arranged with the intermediate hub portion interposed therebetween. The sheet discharge roller is formed with a pair of annular groove portions that a part of the pair of gears can enter. The elastic shaft presses the gear roller against the sheet discharge roller.

A convex circumferential portion that comes into contact with the intermediate hub portion is formed between the pair of annular groove portions. When the sheet discharge roller and the gear roller convey a sheet while nipping the sheet, the gear roller is lifted up against a bias force of the elastic shaft by toughness of the sheet. The conveying apparatus described above will be referred to as a conveying apparatus according to a reference example.

SUMMARY

A medium conveying apparatus according to the present disclosure includes: a drive roller which is rotationally driven about a shaft; a driven roller which conveys a medium nipped by the drive roller and the driven roller while rotating about a shaft in a state where the driven roller is driven by the drive roller; and a supporting portion which supports the driven roller such that the driven roller is movable between a non-conveying position at which the driven roller comes into contact with the drive roller and a conveying position at which the driven roller is set apart from the drive roller by the medium conveyed between the drive roller and the driven roller, and in that the drive roller includes a drive body portion having a cylindrical shape, and a drive contact portion having a cylindrical shape, which is formed of a material having a smaller friction coefficient or a higher surface hardness than the drive body portion, is arranged coaxially with the drive body portion, and is formed with a groove portion along a circumferential direction, the driven roller includes a driven contact portion having a disk shape, which comes into contact with the drive contact portion excluding the groove portion at the non-conveying position, and a plurality of protrusion portions which are arranged in a circumferential direction of the driven contact portion with intervals provided therebetween, protrude outwardly in a radial direction, and are arranged in the groove portion while being set apart from a bottom surface of the groove portion at the non-conveying position, the drive contact portion is formed with a pair of guide portions which guide, to the groove portion, the protrusion portions of the driven roller moving from the conveying position to the non-conveying position, the pair of guide portions being formed by chamfering at least edge portions of the groove portion on an outer circumferential surface side.

In this case, the drive contact portion may be formed to have a smaller diameter than the drive body portion, and form a step portion that is concave with respect to the drive body portion.

In this case, the drive body portion may be formed with a pair of second guide portions which guide, to the step portion, the driven contact portion of the driven roller moving from the conveying position to the non-conveying position, the pair of second guide portions being formed by chamfering at least edge portions of the step portion on the outer circumferential surface side.

In this case, the driven roller, the drive body portion, and the drive contact portion may be provided plurally, and the plurality of drive body portions and the plurality of drive contact portions may be arranged coaxially with one another.

An image forming apparatus according to the present disclosure includes any of the medium conveying apparatuses described above.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the attached drawings. It is noted that Fr, Rr, L, R, U, and D in the diagrams respectively represent front, rear, left, right, up, and down in an image forming apparatus 1. Although terms that indicate directions and positions are used in the present specification, those terms are merely used for convenience of descriptions and do not intend to limit the technical scope of the present disclosure.

[Image Forming Apparatus]

Figure 1:
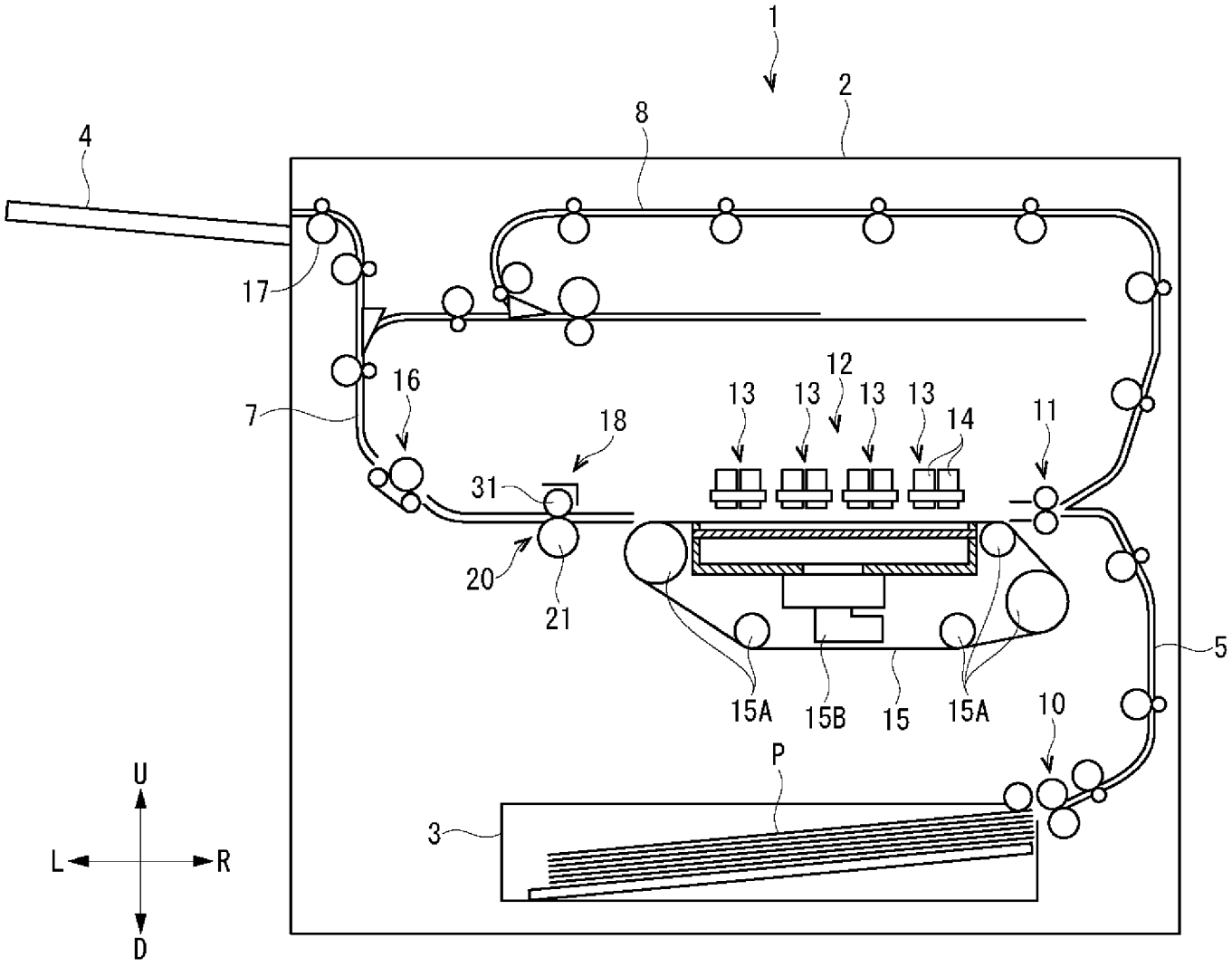
FIG. 1 is a schematic diagram (front view) showing an internal structure of an image forming apparatus according to an embodiment of the present disclosure.

The image forming apparatus 1 will be described with reference to FIG. 1. FIG. 1 is a schematic diagram (front view) showing an internal structure of the image forming apparatus 1.

The image forming apparatus 1 is an inkjet printer that discharges ink drops to form an image on a sheet P. The image forming apparatus 1 includes a box-like housing 2 that houses various types of equipment.

A sheet feed cassette 3 in which sheets P are set is housed at a lower portion of the housing 2. On an upper side of a left side surface of the housing 2, a sheet discharge tray 4 on which printed sheets P are stacked is provided.

It is noted that in the present specification, a direction in which the sheet P as an example of a medium is conveyed is referred to as a "conveying direction". In addition, terms of "upstream" and "downstream" and terms similar to these respectively refer to "upstream" and "downstream" in the conveying direction and concepts similar to these. Moreover, the medium is not limited to a paper sheet P and may be, for example, a resin sheet, film, or the like.

At a right side portion of the housing 2, a first conveying path 5 for conveying the sheet P from the sheet feed cassette 3 toward a head unit 12 is formed. A sheet feed portion 10 is provided at an upstream end portion of the first conveying path 5. Registration rollers 11 are provided at a downstream end portion of the first conveying path 5.

The head unit 12 includes four line heads 13 respectively corresponding to four colors of ink including black, cyan, magenta, and yellow. A plurality of recording heads 14 are mounted on each of the line heads 13.

Ink is supplied to each of the recording heads 14 from ink packs of the respective colors via tubes. The tubes and the ink packs are not shown. A conveying belt 15 bridged across a plurality of stretching rollers 15A is provided below the head unit 12. A plurality of through-holes (not shown) are formed in the conveying belt 15. On an inner side of the conveying belt 15, a suction portion 15B which sucks air via the through-holes is provided.

At a left side portion of the housing 2, a second conveying path 7 for conveying the sheet P from the head unit 12 toward the sheet discharge tray 4 is formed. A medium conveying apparatus 18 is provided on an upstream side of the second conveying path 7.

A de-curling device 16 is provided at a midstream portion of the second conveying path 7. A sheet discharge portion 17 is provided at a downstream end portion of the second conveying path 7. At an upper portion inside the housing 2, a third conveying path 8 for re-conveying the sheet P from the middle of the second conveying path 7 to the registration rollers 11 is formed.

[Image Forming Processing]

Herein, image forming processing will be described. The image forming apparatus 1 includes a control portion (not shown). The control portion controls various types of control target equipment as appropriate and executes the image forming processing as follows.

The sheet feed portion 10 picks up a sheet P from the sheet feed cassette 3 and feeds the sheet P to the first conveying path 5. The registration rollers 11 temporarily block the sheet P to correct a skew. The registration rollers 11 further feed the sheet P to the conveying belt 15 in accordance with a timing at which the line heads 13 discharge ink drops.

The sheet P is conveyed while being sucked on the conveying belt 15. The recording heads 14 mounted on the head unit 12 discharge ink drops toward the sheet P on the conveying belt 15 from a plurality of nozzles (not shown). Thus, the plurality of recording heads 14 form a full-color image.

The medium conveying apparatus 18 includes a conveying roller pair 20. The conveying roller pair 20 conveys the sheet P formed with an image toward a downstream side of the conveying direction. The de-curling device 16 corrects a curl of the sheet P.

The sheet P subjected to one-side printing passes through the second conveying path 7 to be discharged onto the sheet discharge tray 4. When double-sided printing is executed, the sheet P that has been subjected to one-side printing enters the third conveying path 8, is flipped backwards, and is conveyed toward the registration rollers 11 again. After that, an image is formed on a back surface of the sheet P in the order similar to that in the one-side printing described above. The sheet P thus subjected to the double-sided printing is discharged onto the sheet discharge tray 4.

Incidentally, in the conveying apparatus according to the reference example, the gear roller rotates in a state where the intermediate hub portion is in contact with the convex circumferential portion of the sheet discharge roller. Therefore, the convex circumferential portion is more apt to be abraded than other portions.

In the conveying apparatus according to the reference example, sufficient considerations are not given to the abrasion of the sheet discharge roller. Also in the conveying apparatus according to the reference example, when the conveyance of the sheets is ended, the gear roller moves toward the sheet discharge roller by a bias force of the elastic shaft.

When there is a positional deviation between the pair of gears and the pair of annular groove portions, there has been a fear that the pair of gears will interfere with the convex circumferential portion, and thus the pair of gears will not enter the pair of annular groove portions.

Hereinafter, a configuration for suppressing the abrasion of the drive roller and also smoothly guiding protrusion portions to a groove portion will be described.

First Embodiment: Medium Conveying Apparatus

Figure 2:
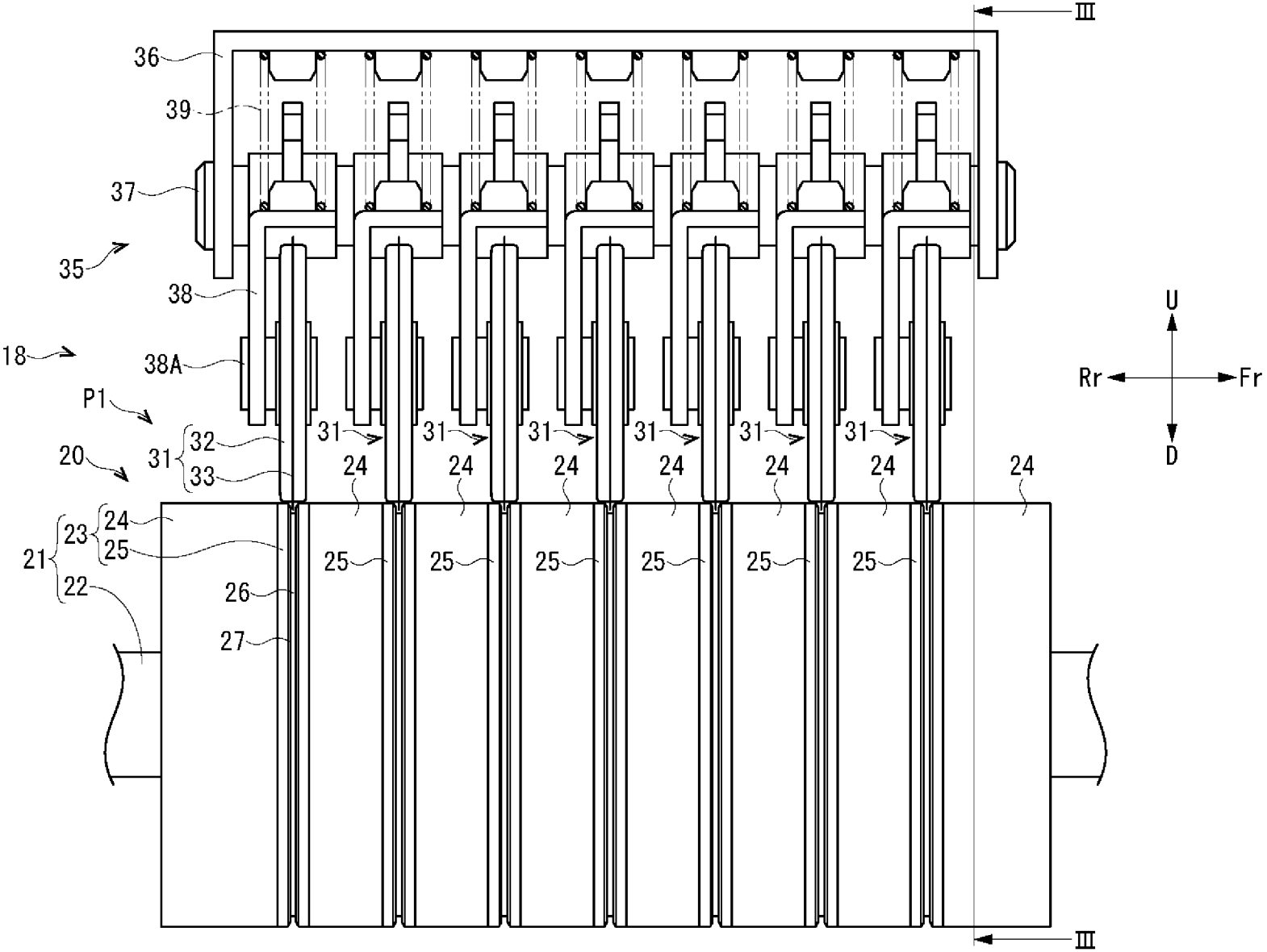
FIG. 2 is a side view showing a medium conveying apparatus according to a first embodiment of the present disclosure.
Figure 3:
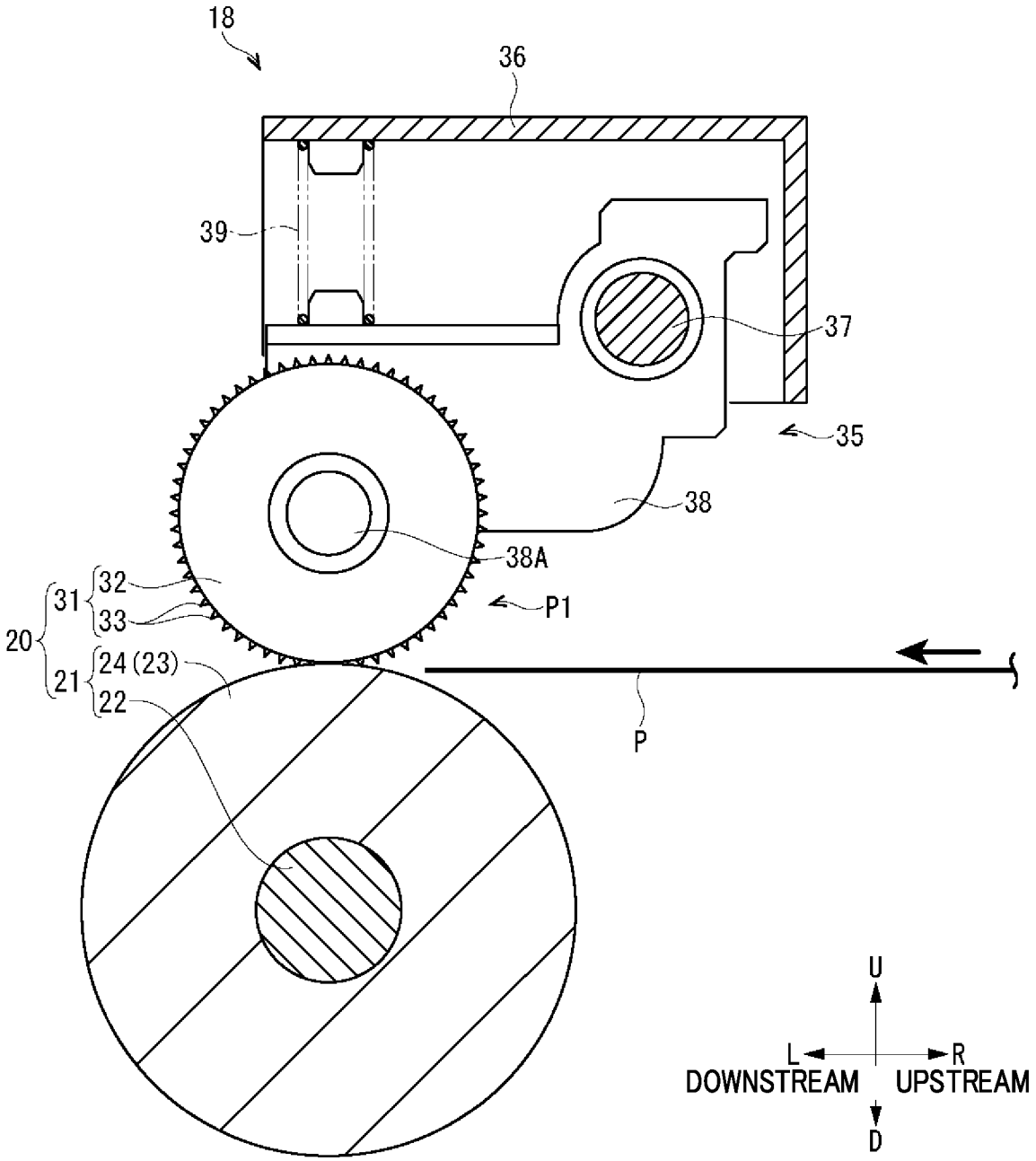
FIG. 3 is a cross-sectional view taking along the line III-III in FIG. 2.
Figure 4:
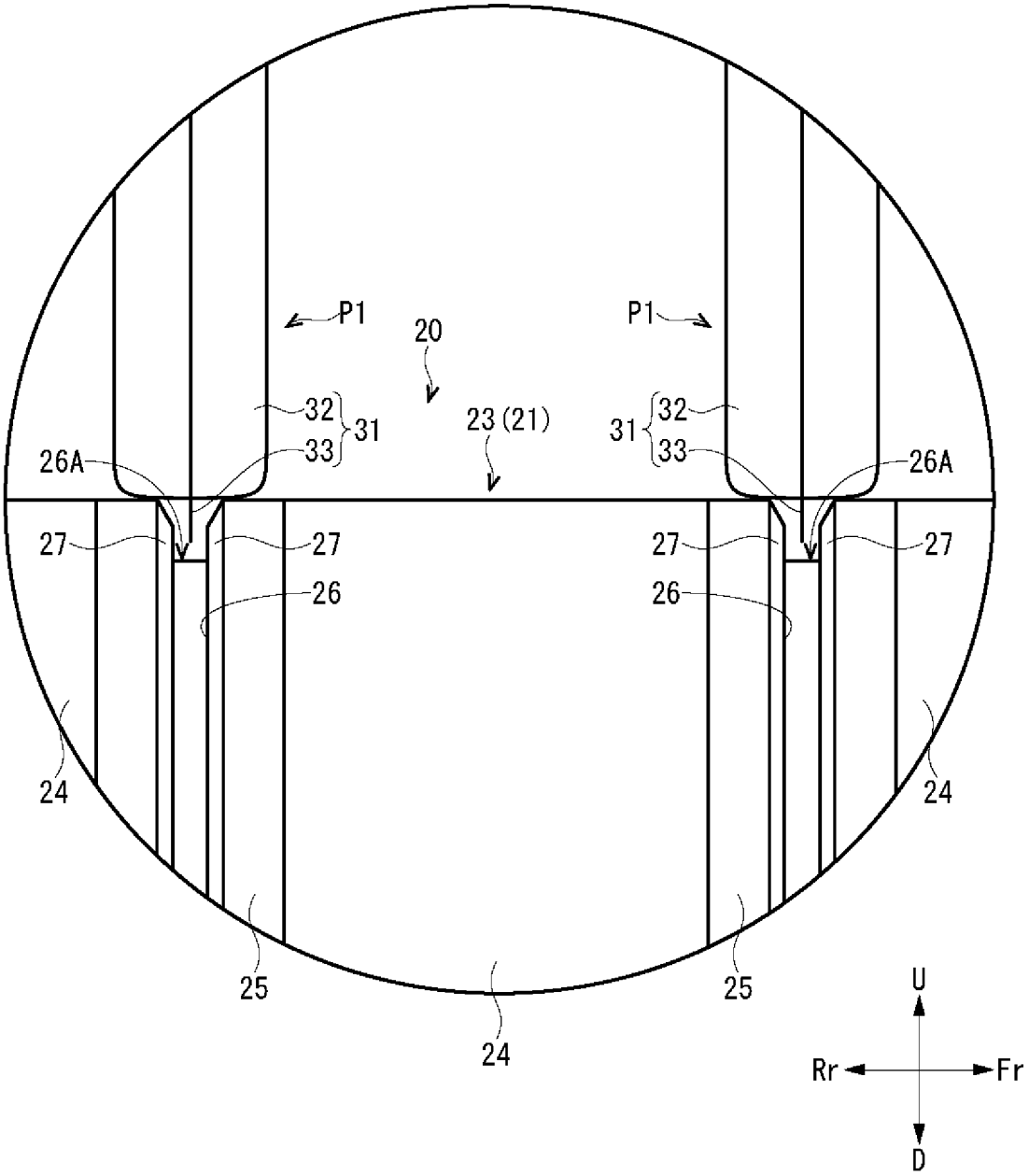
FIG. 4 is a side view showing a part of the medium conveying apparatus according to the first embodiment of the present disclosure in a state where a driven roller is arranged at a non-conveying position.

The medium conveying apparatus 18 according to the first embodiment will be described with reference to FIG. 2 to FIG. 4. FIG. 2 is a side view of the medium conveying apparatus 18. FIG. 3 is a cross-sectional view taking along the line III-Ill in FIG. 2. FIG. 4 is an enlarged side view showing a part of the medium conveying apparatus 18.

The medium conveying apparatus 18 includes a plurality of conveying roller pairs 20 and a plurality of supporting portions 35. For example, the medium conveying apparatus 18 includes four conveying roller pairs 20 and four supporting portions 35.

The plurality of conveying roller pairs 20 and the plurality of supporting portions 35 are arranged in line along a front-rear direction of the image forming apparatus 1 with intervals provided therebetween. The front-rear direction is a width direction orthogonal to the conveying direction.

It is noted that the plurality of conveying roller pairs 20 and the plurality of supporting portions 35 respectively have the same structure, so hereinafter, descriptions will be given on one conveying roller pair 20 and one supporting portion 35.

<Conveying Roller Pair>

As shown in FIG. 2 and FIG. 3, the conveying roller pair 20 includes a drive roller 21 and a plurality of driven rollers 31. In the example shown in FIG. 2, the conveying roller pair 20 includes seven driven rollers 31.

The drive roller 21 is rotationally driven about a shaft. The driven rollers 31 are driven by the drive roller 21 and rotate about a shaft. The driven rollers 31 convey, while rotating, the sheet P nipped by the driven rollers 31 and the drive roller 21.

The driven rollers 31 come into contact with an image forming surface of the sheet P that has passed through the head unit 12, and the drive roller 21 comes into contact with the back surface of the sheet P. The image forming surface is a front surface of the sheet P. It is noted that the plurality of driven rollers 31 have the same structure, so hereinafter, descriptions will be given on one driven roller 31.

<Drive Roller>

The drive roller 21 includes a drive shaft 22 and a roller body portion 23. The drive shaft 22 is arranged along the front-rear direction of the image forming apparatus 1. The roller body portion 23 is fixed to a circumferential surface of the drive shaft 22.

Both end portions of the drive shaft 22 are rotatably supported by a frame (not shown) provided inside the housing 2. The drive shaft 22 is connected to a drive source (not shown) such as an electric motor. The drive shaft 22 rotates about a shaft upon receiving a drive force from the drive source.

(Roller Body Portion)

As shown in FIG. 2, the roller body portion 23 includes a plurality of drive body portions 24 and a plurality of drive contact portions 25. In the example shown in FIG. 2, the roller body portion 23 includes eight drive body portions 24 and seven drive contact portions 25.

The plurality of drive body portions 24 and the plurality of drive contact portions 25 are formed substantially in a cylindrical shape having substantially the same diameter. The plurality of drive body portions 24 and the plurality of drive contact portions 25 are coaxially arranged next to one another substantially without gaps. The plurality of drive body portions 24 and the plurality of drive contact portions 25 form one roller having a predetermined length in an axial direction.

It is noted that since the plurality of drive body portions 24 have substantially the same structure, hereinafter, descriptions will be given on one drive body portion 24. Similarly, hereinafter, descriptions will be given on one drive contact portion 25.

For example, the drive body portion 24 and the drive contact portion 25 are each an elastic body formed of synthetic rubber or the like. The drive contact portion 25 is formed of a material having a smaller friction coefficient or a higher surface hardness than the drive body portion 24. In other words, the drive contact portion 25 has a higher abrasion resistance than the drive body portion 24.

Further, in the drive contact portion 25, a groove portion 26 is formed along a circumferential direction. As shown in FIG. 4, the groove portion 26 is dented substantially in a U shape from an outer circumferential surface of the drive contact portion 25 toward a shaft center. Moreover, a pair of guide portions 27 are formed in the drive contact portion 25. The pair of guide portions 27 are portions formed by chamfering a pair of edge portions of the groove portion 26 on the outer circumferential surface side.

In the example shown in FIG. 4, the pair of guide portions 27 are portions obtained by so-called C chamfering. In this case, the pair of guide portions 27 form inclined surfaces that widen from a bottom surface 26A side of the groove portion 26 toward the outer circumferential surface.

(Driven Roller)

As shown in FIG. 2 and FIG. 3, the driven roller 31 includes a driven contact portion 32 and a plurality of protrusion portions 33. The driven contact portion 32 is formed in a disk shape. The plurality of protrusion portions 33 are arranged in the circumferential direction at an outer edge of the driven contact portion 32 with intervals provided therebetween, and each of the protrusion portions 33 protrudes outwardly in a radial direction.

Herein, an example of the structure of the driven roller 31 will be described. The driven contact portion 32 includes a pair of disks (not shown). The driven roller 31 has a structure in which a thin gear-like piece including the plurality of protrusion portions 33 is sandwiched between the pair of disks.

The driven contact portion 32 is formed of the same material as the drive contact portion 25, for example. For example, each of the protrusion portions 33 is formed in a needle-like shape by a synthetic resin or the like. Although details will be given later, the driven contact portion 32 comes into contact with the drive contact portion 25 of the drive roller 21 so that the protrusion portions 33 can enter the groove portion 26 of the drive contact portion 25. It is noted that in the side view shown in FIG. 2 and the like, the plurality of protrusion portions 33 are illustrated with one line for simplification.

<Supporting Portion>

As shown in FIG. 2 and FIG. 3, the supporting portion 35 includes a roller holder 36, a pivot shaft 37, a plurality of pivot arms 38, and a plurality of bias members 39. In the example shown in FIG. 2, the supporting portion 35 includes seven pivot arms 38 and seven bias members 39.

It is noted that since the plurality of pivot arms 38 have the same structure, hereinafter, descriptions will be given on one pivot arm 38. Similarly, hereinafter, descriptions will be given on one bias member 39.

(Roller Holder, Pivot Shaft)

The roller holder 36 has a box-like shape that is opened in a downward direction and a leftward direction and houses therein the seven driven rollers 31. The pivot shaft 37 is arranged along the front-rear direction and is rotatably supported by side plates at both the front and rear of the roller holder 36 (see FIG. 2).

(Pivot Arm)

The seven pivot arms 38 are arranged substantially at regular intervals in the front-rear direction. A right end portion of the pivot arm 38 is fixed to the pivot shaft 37 (see FIG. 3). The pivot arm 38 is supported by the pivot shaft 37 such that the pivot arm 38 is pivotable in an up-down direction. The pivot arm 38 is formed so as to extend in the leftward direction from the pivot shaft 37. The leftward direction is the conveying direction. At a leftward tip end portion of the pivot arm 38, the driven roller 31 is rotatably supported via a supporting shaft 38A.

(Bias Member)

The bias member 39 is a compression coil spring, for example. The bias member 39 is erected between the roller holder 36 and the pivot arm 38. The bias member 39 biases the pivot arm 38 toward the drive roller 21.

[Action of Medium Conveying Apparatus]

Figure 5:
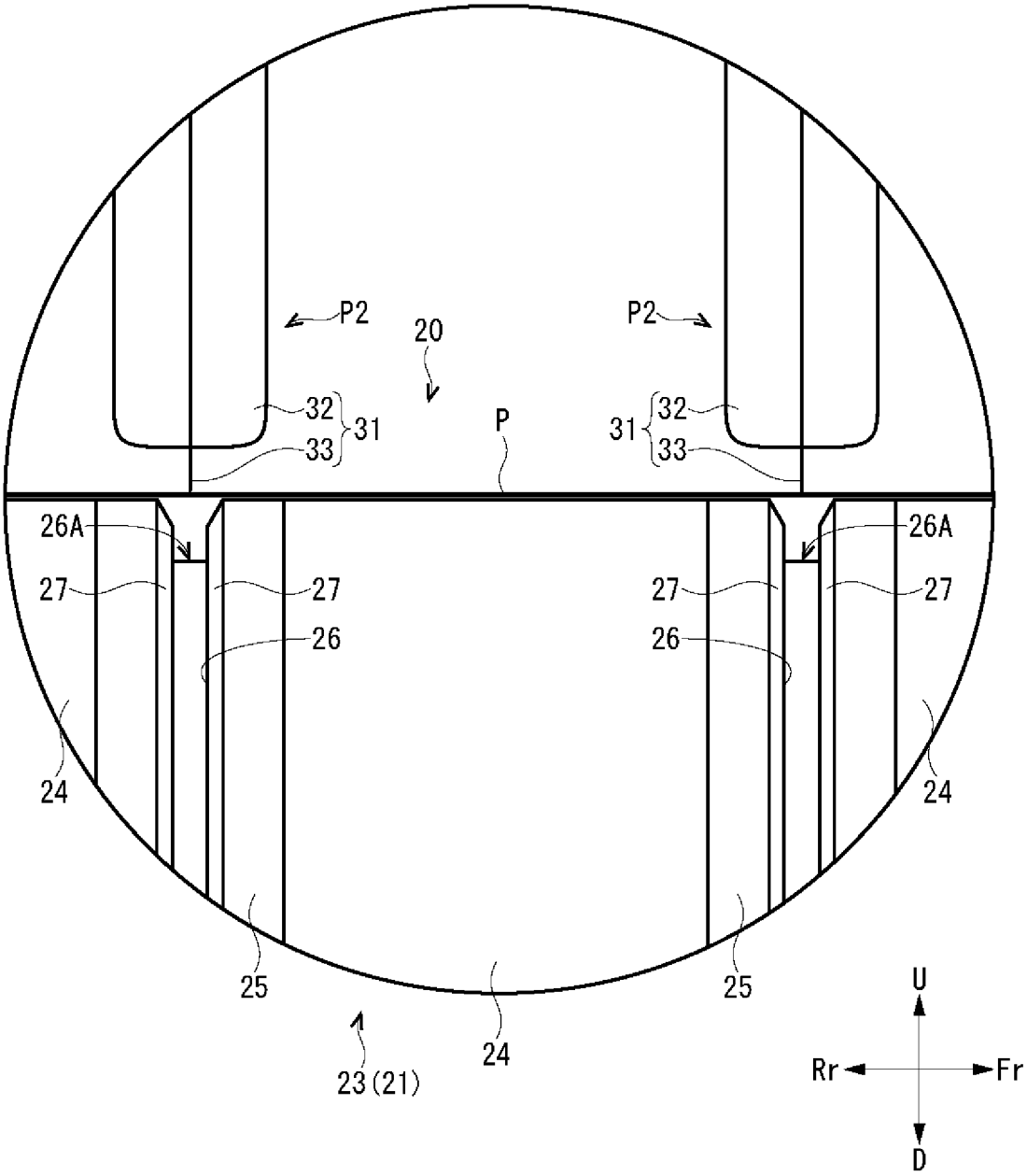
FIG. 5 is a side view showing a part of the medium conveying apparatus according to the first embodiment of the present disclosure in a state where the driven roller is arranged at a conveying position.
Figure 6:
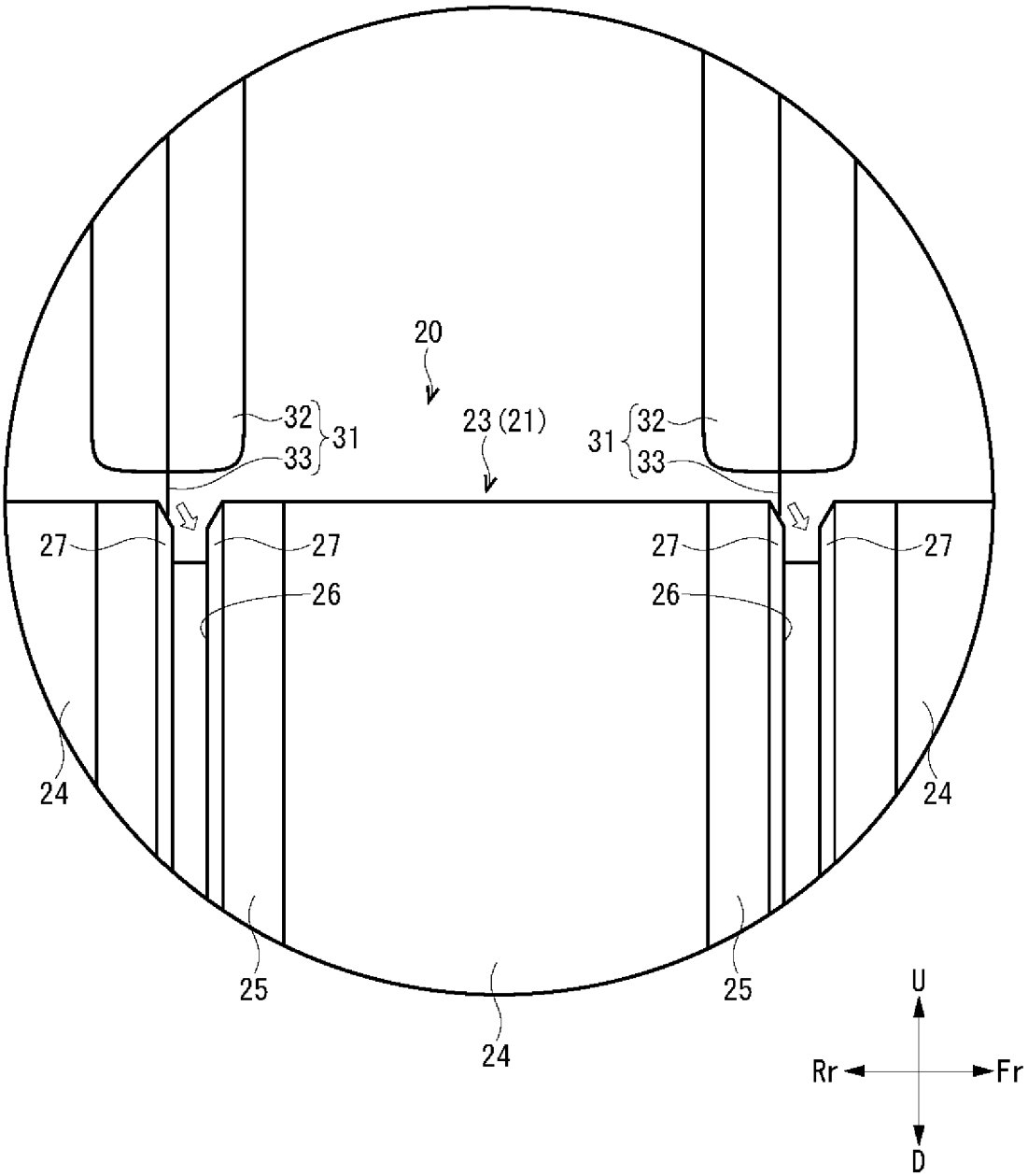
FIG. 6 is a side view showing a part of the medium conveying apparatus according to the first embodiment of the present disclosure, the view showing a process in which the driven roller moves from the conveying position to the non-conveying position.

Next, an action of the medium conveying apparatus 18 will be described with reference to FIG. 4 to FIG. 7. FIG. 5 is a side view showing a state where the driven roller 31 is arranged at a conveying position P2. FIG. 6 is a side view showing a process in which the driven roller 31 moves from the conveying position P2 to a non-conveying position P1.

The supporting portion 35 described above supports the driven rollers 31 such that the driven rollers 31 are movable between the non-conveying position P1 and the conveying position P2.

Specifically, in a state where the sheet P is not conveyed, the pivot arm 38 is biased by the bias member 39 and rotates downwardly, to thus arrange the driven roller 31 at the non-conveying position P1. As shown in FIG. 4, the driven roller 31 is in contact with the drive roller 21 at the non-conveying position P1.

At the non-conveying position P1, the driven contact portion 32 comes into contact with a portion of the drive contact portion 25 excluding the groove portion 26 with a predetermined pressure, and the protrusion portions 33 are arranged in the groove portion 26 while being set apart from the bottom surface 26A of the groove portion 26.

When the drive roller 21 is driven by the drive source and rotates, the driven roller 31 is driven to rotate while being in contact with the drive contact portion 25. The drive contact portion 25 of the drive roller 21 is apt to be abraded by an abrasion with the driven contact portion 32 of the driven roller 31 or an abrasion with the sheet P.

As a countermeasure for the problem as described above, in the medium conveying apparatus 18 according to the first embodiment, the drive contact portion 25 has a higher abrasion resistance than the drive body portion 24. With this configuration, the abrasion of the drive contact portion 25 can be suppressed, and a replacement frequency of the drive roller 21 can be lowered. It is noted that proper conveyance of the sheet P is ensured by the drive body portion 24.

Meanwhile, in a state where the sheet P is conveyed, the pivot arm 38 rotates upwardly by the sheet P conveyed between the drive roller 21 and the driven roller 31, and thus the driven roller 31 moves from the non-conveying position P1 to the conveying position P2. As shown in FIG. 5, the driven roller 31 is set apart from the drive roller 21 at the conveying position P2.

At the conveying position P2, the protrusion portions 33 are detached from the groove portion 26 to come into contact with the image forming surface of the sheet P, and the driven contact portion 32 is set apart from the sheet P. The drive body portion 24 and the drive contact portion 25 of the roller body portion 23 come into contact with the back surface of the sheet P.

As described above, since only the protrusion portions 33 come into contact with the image forming surface of the sheet P, a situation where ink on the sheet P adheres onto the driven contact portion 32 of the driven roller 31 is suppressed. Moreover, the plurality of driven rollers 31, the plurality of drive body portions 24, and the plurality of drive contact portions 25 are provided in the axial direction with intervals provided therebetween. Therefore, sheets P of various sizes (widths) can be conveyed properly.

Next, as the conveyance of the sheet P ends, the pivot arm 38 is biased by the bias member 39 to rotate downwardly, and thus the driven roller 31 moves from the conveying position P2 to the non-conveying position P1.

Incidentally, for example, the driven roller 31 may take an attitude in which the driven roller 31 is slightly tilted with respect to the conveying direction when applied with a reaction force from the sheet P being conveyed. In this case, the protrusion portions 33 may deviate from the groove portion 26 and interfere with the surface of the drive contact portion 25 without entering the groove portion 26. The portion that interferes with the protrusion portions 33 is the edge portion of the groove portion 26.

As a countermeasure for the problem as described above, the medium conveying apparatus 18 according to the first embodiment includes the guide portions 27. When the driven roller 31 moves from the conveying position P2 to the non-conveying position P1, the guide portions 27 guide the protrusion portions 33 of the driven roller 31 to the groove portion 26.

As shown in FIG. 6, even if the protrusion portions 33 deviate from the groove portion 26, the protrusion portions 33 slide toward the groove portion 26 while being in contact with the guide portion 27 (see open arrows shown in FIG. 6). Thus, the protrusion portions 33 smoothly enter the groove portion 26. Therefore, breakage of the protrusion portions 33 is suppressed, and the driven roller 31 appropriately returns to the non-conveying position P1.

It is noted that in the medium conveying apparatus 18 according to the first embodiment, the guide portions 27 are formed by C-chamfering the pair of edge portions of the groove portion 26, but the present disclosure is not limited thereto.

Figure 7A:
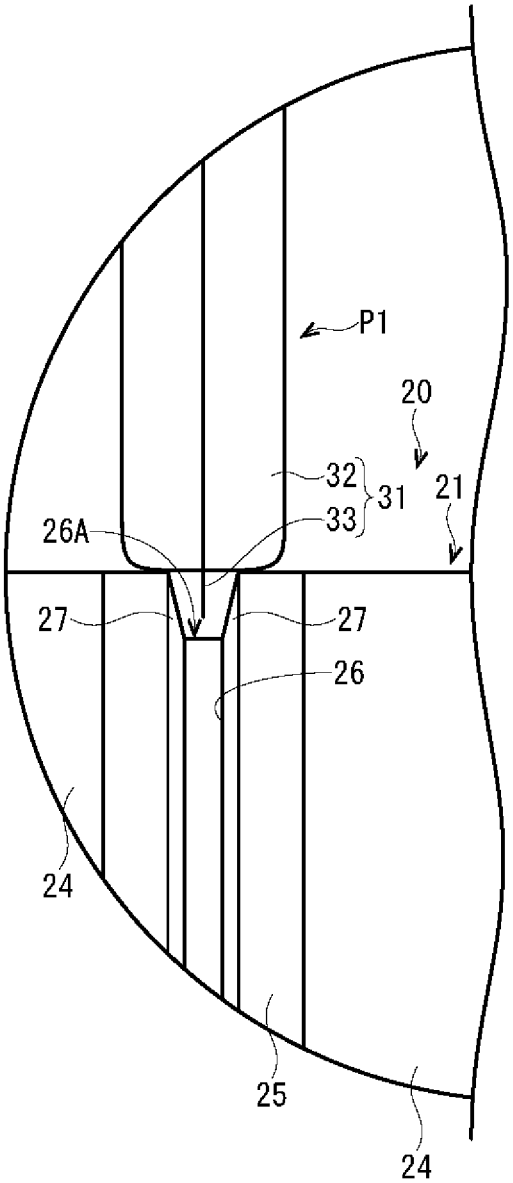
FIG. 7A is an enlarged side view showing a part of a medium conveying apparatus according to a modified example of the first embodiment of the present disclosure.
Figure 7B:
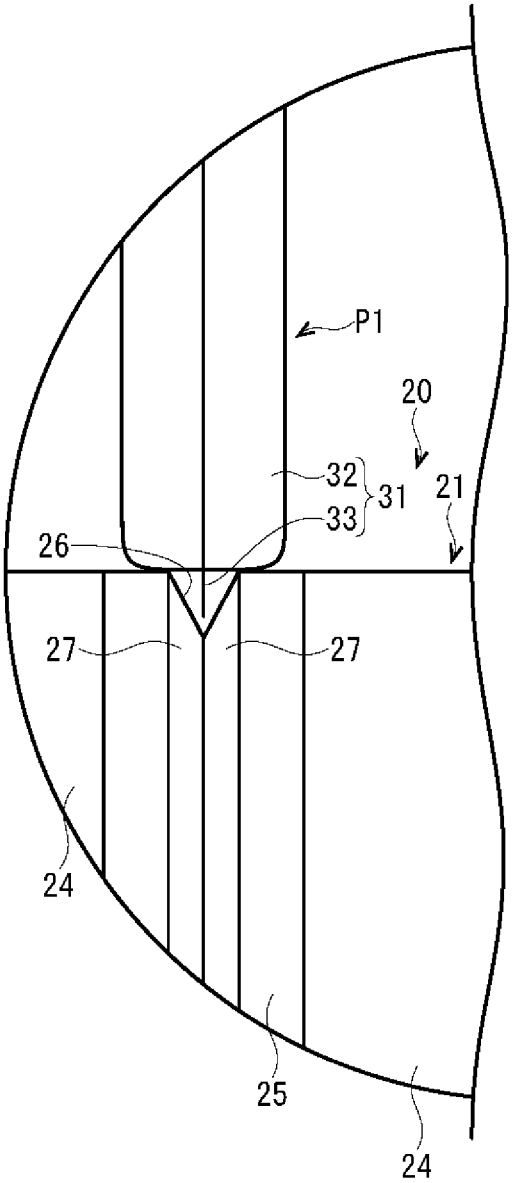
FIG. 7B is an enlarged side view showing a part of a medium conveying apparatus according to another modified example of the first embodiment of the present disclosure.

For example, the guide portions 27 may be formed by performing so-called R chamfering in which the edge portions of the groove portion 26 are rounded (not shown). Alternatively, as shown in FIG. 7A, for example, it is also possible to form inner surfaces of the groove portion 26 as inclined surfaces so that the guide portions 27 become the inner surfaces of the groove portion 26. Alternatively, as shown in FIG. 7B, the groove portion 26 may be formed to have substantially a V-shaped cross section (not shown).

Second Embodiment: Medium Conveying Apparatus

Figure 8:
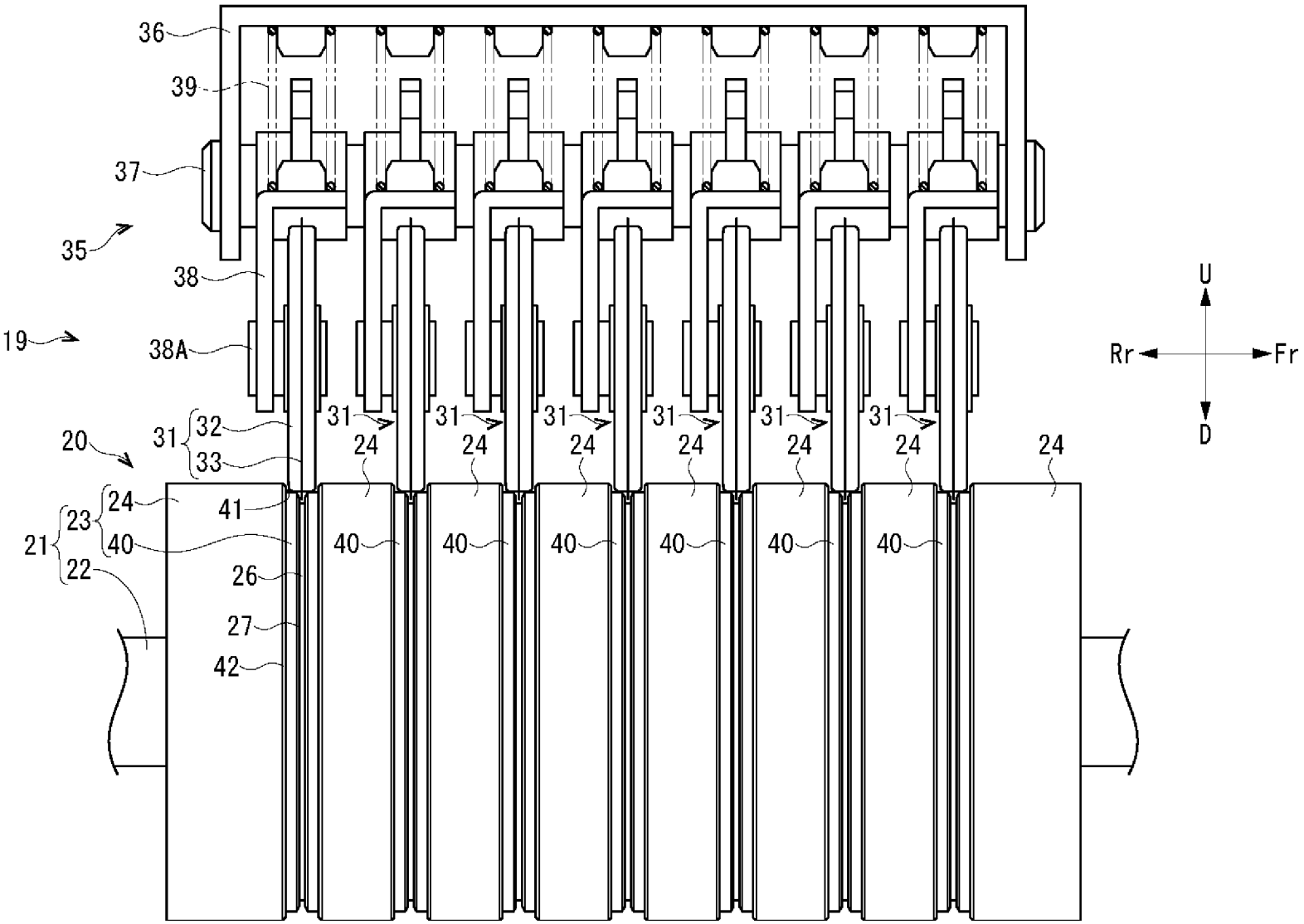
FIG. 8 is a side view showing a medium conveying apparatus according to a second embodiment of the present disclosure.
Figure 9:
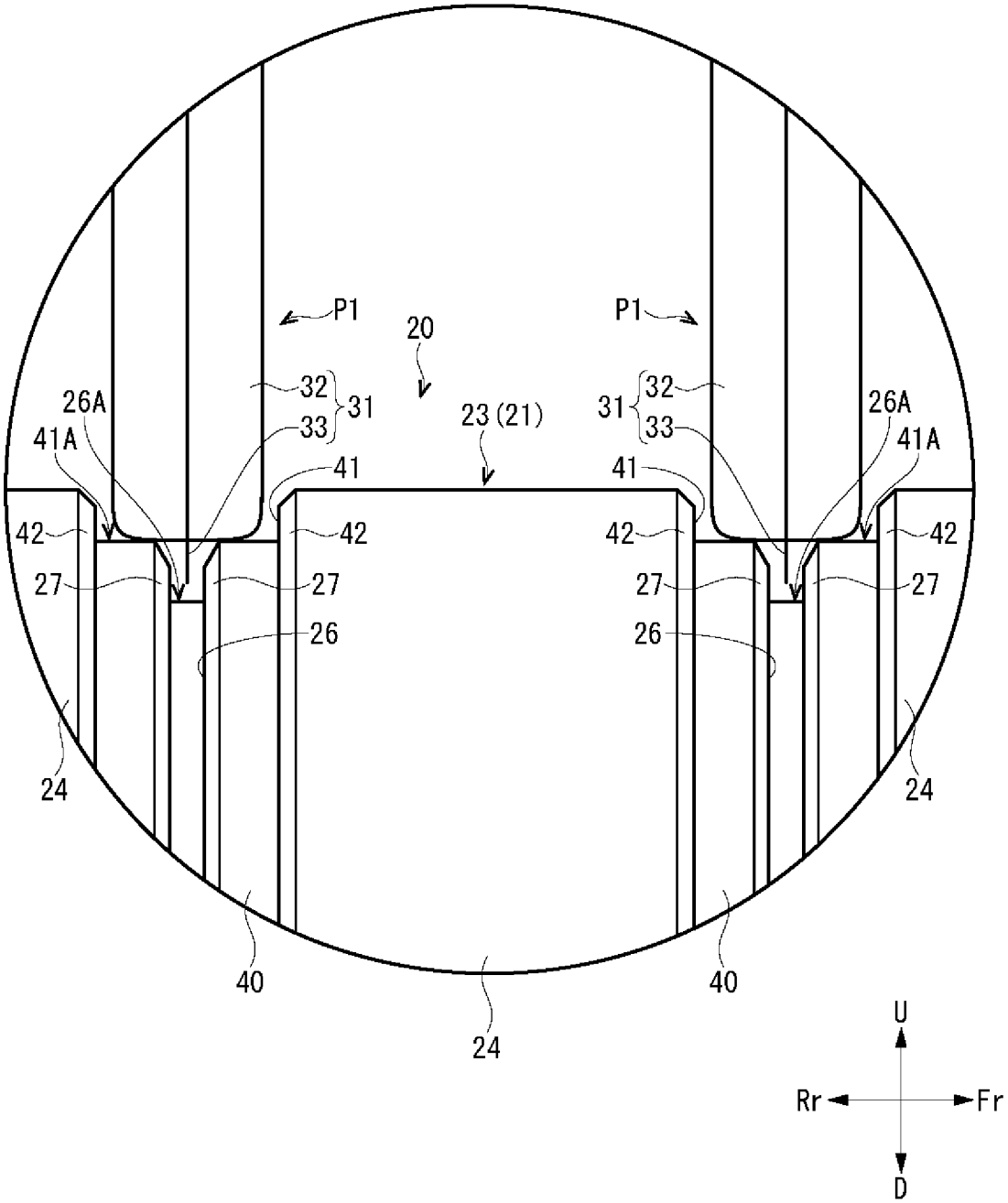
FIG. 9 is a side view showing a part of the medium conveying apparatus according to the second embodiment of the present disclosure in a state where the driven roller is arranged at the non-conveying position.
Figure 10:
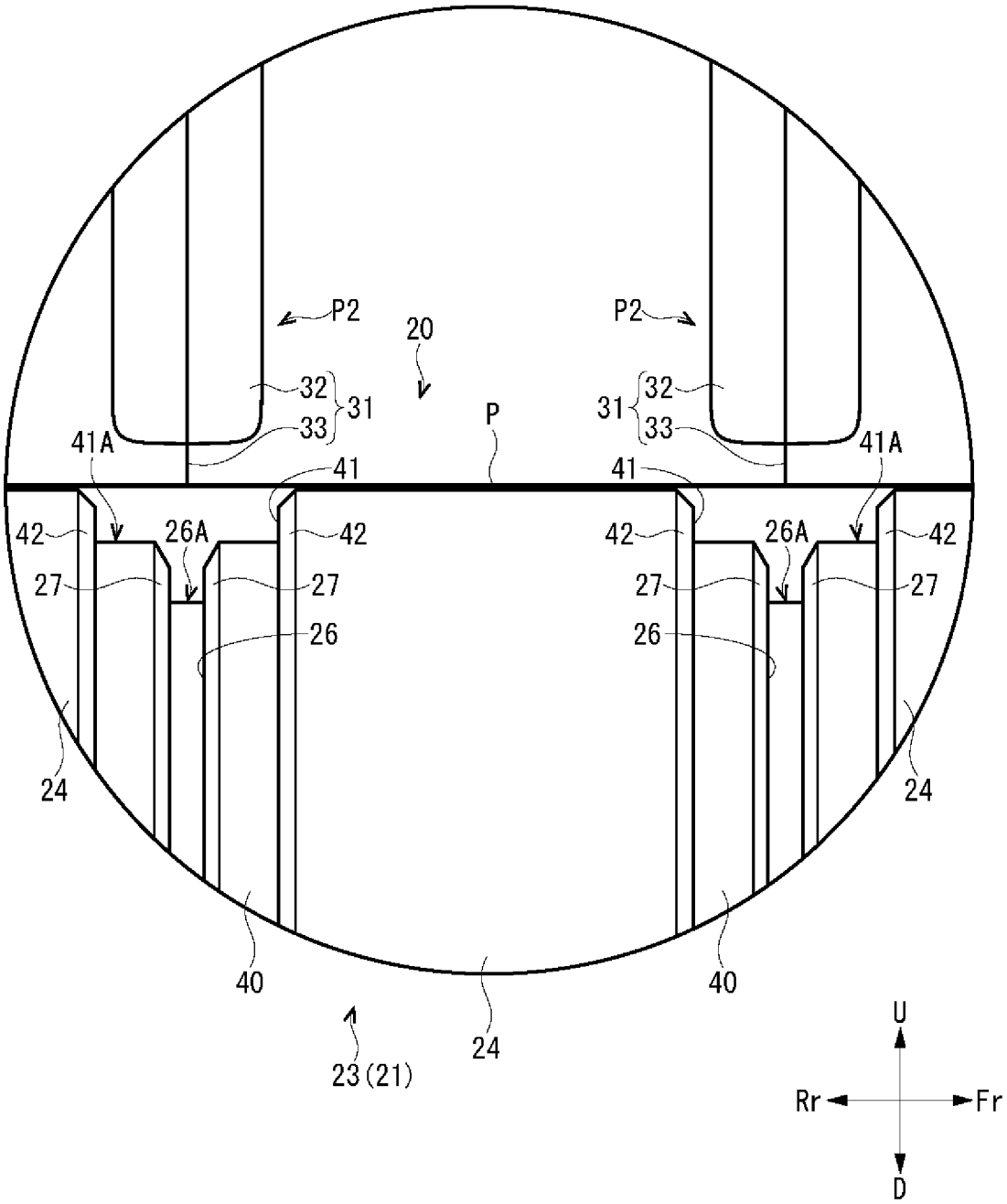
FIG. 10 is a side view showing a part of the medium conveying apparatus according to the second embodiment of the present disclosure in a state where the driven roller is arranged at the conveying position.
Figure 11:
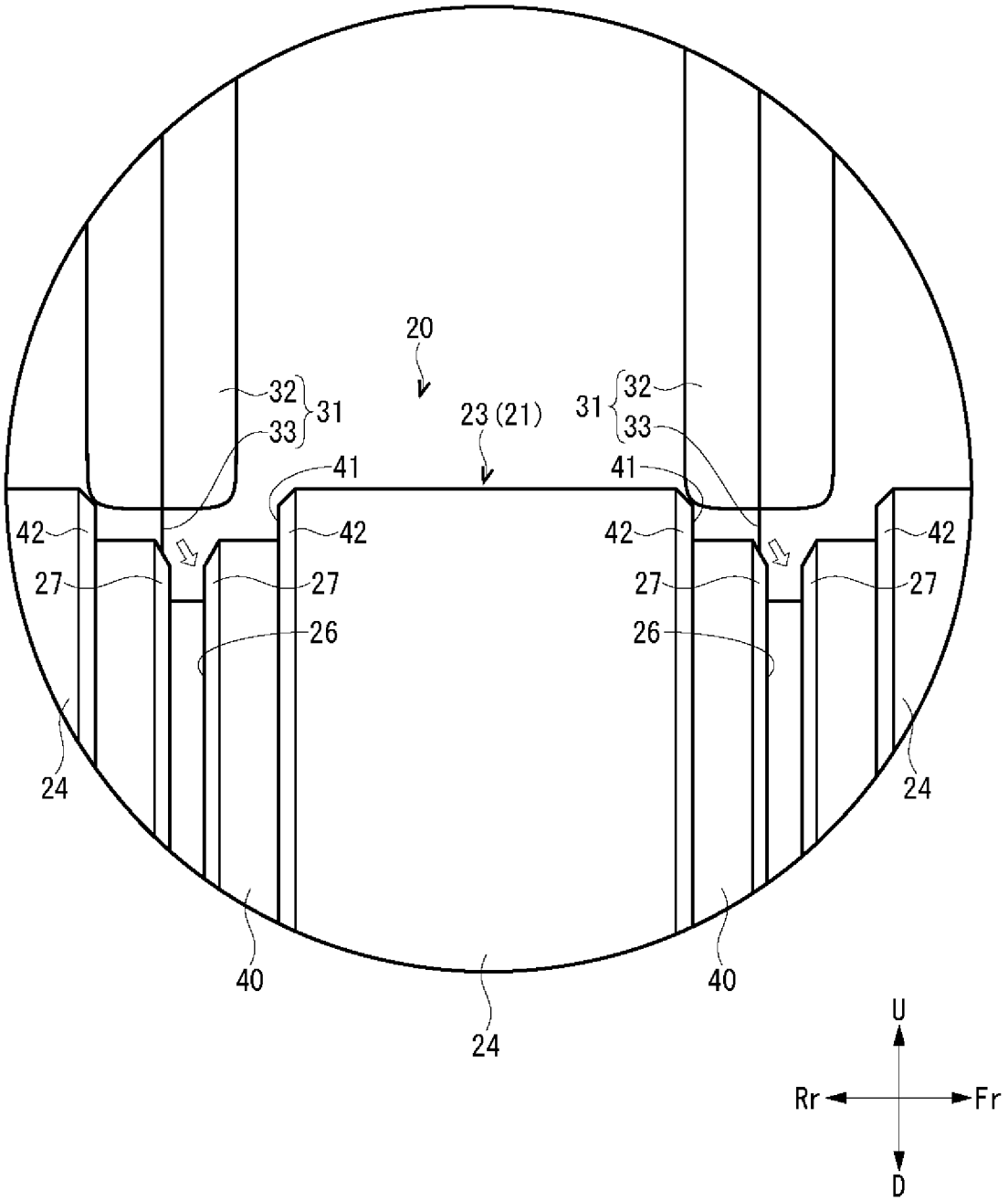
FIG. 11 is a side view showing a part of the medium conveying apparatus according to the second embodiment of the present disclosure, the view showing a process in which the driven roller moves from the conveying position to the non-conveying position.

A medium conveying apparatus 19 according to a second embodiment will be described with reference to FIG. 8 to FIG. 11. FIG. 8 is a side view of the medium conveying apparatus 19. FIG. 9 and FIG. 10 are each an enlarged side view showing a part of the medium conveying apparatus 19. FIG. 11 is a side view showing a process in which the driven roller 31 moves from the conveying position P2 to the non-conveying position P1. It is noted that in descriptions below, configurations that are the same as or correspond to those of the medium conveying apparatus 18 according to the first embodiment described above are denoted by the same reference symbols, and descriptions thereof will be omitted.

In the medium conveying apparatus 18 according to the first embodiment, the drive body portion 24 and the drive contact portion 25 are formed substantially in a cylindrical shape having substantially the same diameter. On the other hand, in the medium conveying apparatus 19 according to the second embodiment, a drive contact portion 40 of the drive roller 21 is formed to have a smaller diameter than the drive body portion 24 as shown in FIG. 8. The medium conveying apparatus 19 differs from the medium conveying apparatus 18 in this point.

As shown in FIG. 8 and FIG. 9, the drive contact portion 40 forms a step portion 41 that is concave with respect to the drive body portion 24. The step portion 41 is formed substantially as a U-shaped concave groove formed along the circumferential direction.

The groove portion 26 is formed to be concave on a bottom surface 41A of the step portion 41. The bottom surface 41A of the step portion 41 is an outer circumferential surface of the drive contact portion 40.

Further, a pair of second guide portions 42 are formed in the drive body portion 24. The pair of second guide portions 42 are portions formed by chamfering a pair of edge portions of the step portion 41 on the outer circumferential surface side. The pair of second guide portions 42 are portions obtained by so-called C chamfering. The pair of second guide portions 42 form inclined surfaces that widen from the bottom surface 41A side of the step portion 41 toward the outer circumferential surface.

[Action of Medium Conveying Apparatus]

As shown in FIG. 9, in a state where the driven roller 31 is arranged at the non-conveying position P1, the driven contact portion 32 enters the step portion 41 to come into contact with the outer circumferential surface of the drive contact portion 40. The portion that comes into contact with the driven contact portion 32 is the bottom surface 41A of the step portion 41. Moreover, the protrusion portions 33 are arranged in the groove portion 26 without coming into contact with the bottom surface 26A.

Next, as shown in FIG. 10, when the sheet P is conveyed, the driven roller 31 is arranged at the conveying position P2. In a state where the driven roller 31 is arranged at the conveying position P2, the driven contact portion 32 is detached from the step portion 41 to be set apart from the sheet P, and the protrusion portions 33 are detached from the groove portion 26 to come into contact with the front surface of the sheet P.

Incidentally, since the drive contact portion 40 has a smaller friction coefficient than the drive body portion 24, a conveying force of the sheet P becomes lower than that of the drive body portion 24.

When the drive body portion 24 and the drive contact portion 25 have substantially the same diameter as in the medium conveying apparatus 18 according to the first embodiment, a portion having a high conveying force and a portion having a low conveying force are mixed throughout the drive roller 21 in the axial direction. Therefore, there has been a possibility that a conveyance failure of the sheet P including a wrinkle of the sheet P being conveyed, a tilt of the conveying direction of the sheet P, and the like will occur.

As a countermeasure for the problem as described above, in the medium conveying apparatus 19 according to the second embodiment, the drive contact portion 40 is formed to have a smaller diameter than the drive body portion 24 and has a concave portion that is dented by a step. Therefore, while the drive body portion 24 comes into contact with the back surface of the sheet P, the drive contact portion 40 does not come into contact with the sheet P. With this configuration, it is possible to suppress the conveyance failure of the sheet P due to a difference in frictional forces, that is, conveying forces, and ensure stable conveyance of the sheet P.

Next, when the conveyance of the sheet P ends, the driven roller 31 moves from the conveying position P2 to the non-conveying position P1. Incidentally, for example, the driven roller 31 may take an attitude in which the driven roller 31 is slightly tilted with respect to the conveying direction. In this case, the driven contact portion 32 may interfere with the surface of the drive body portion 24 without smoothly entering the step portion 41. The portion that interferes with the driven contact portion 32 is the edge portion of the step portion 41.

As a countermeasure for the problem as described above, the medium conveying apparatus 19 according to the second embodiment includes the pair of second guide portions 42. The pair of second guide portions 42 guide, to the step portion 41, the driven contact portion 32 of the driven roller 31 moving from the conveying position P2 to the non-conveying position P1.

As shown in FIG. 11, even if the driven roller 31 deviates from the step portion 41, the driven contact portion 32 slides toward the step portion 41 while being in contact with the second guide portion 42 (see open arrows shown in FIG. 11). Thus, breakage of the driven contact portion 32 is suppressed, and the driven contact portion 32 smoothly enters the step portion 41. It is noted that when the driven contact portion 32 comes into contact with the second guide portion 42, the protrusion portions 33 come into contact with the guide portion 27.

It is noted that in the medium conveying apparatus 19 according to the second embodiment, the second guide portions 42 are formed by C-chamfering the edge portions of the step portion 41, but the present disclosure is not limited thereto.

For example, the second guide portions 42 may be formed by performing so-called R chamfering in which the pair of edge portions of the step portion 41 are rounded (not shown). Alternatively, for example, it is also possible to form a pair of inner surfaces of the step portion 41 as inclined surfaces so that the pair of second guide portions 42 become the pair of inner surfaces of the step portion 41.

Alternatively, the step portion 41 may be formed to have substantially a V-shaped cross section (not shown). Alternatively, the second guide portions 42 may be omitted as long as the drive contact portion 40 is formed with a width with which a deviation of the driven contact portion 32 of the driven roller 31 in the axial direction can be allowed (not shown).

It is noted that although seven driven rollers 31 are provided in the medium conveying apparatuses 18 and 19 according to the first and second embodiments, the present disclosure is not limited thereto. The number of driven rollers 31 only needs to be one or more. Moreover, the number of drive contact portions 25 and 40 and the number of drive body portions 24 of the drive roller 21 only need to be increased/decreased according to the number of driven rollers 31.

It is noted that although ink drops have been discharged from the nozzles of the recording heads 14 in the image forming apparatus 1 described above, liquid drops to be discharged from the nozzles are not limited to the ink drops. For example, liquid drops to be discharged from the nozzles may be water, a liquid adhesive, a liquid synthetic resin, or the like.

In addition, although the image forming apparatus 1 described above has been a color printer, the present disclosure is not limited thereto. For example, the image forming apparatus 1 may be a monochrome printer, a copying machine, a facsimile, or the like. Furthermore, an image forming system of the image forming apparatus 1 is not limited to the inkjet system, and electrophotography may also be used.

It is noted that the descriptions on the embodiments described above merely indicate an aspect in the medium conveying apparatus and image forming apparatus according to the present disclosure. The technical scope of the present disclosure is not limited to the embodiments described above and may be variously changed, substituted, or modified without departing from the gist of the technical idea of the present disclosure. The scope of claims include all embodiments that may be included in the range of the technical idea.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A medium conveying apparatus, comprising:

a drive roller which rotates by being driven;

a driven roller which conveys a medium nipped by the drive roller and the driven roller while rotating in a state where the driven roller is driven by the drive roller; and a supporting portion which supports the driven roller such that the driven roller is movable between a non-conveying position at which the driven roller comes into contact with the drive roller and a conveying position at which the driven roller is set apart from the drive roller, wherein the driven roller moves from the non-conveying position to the conveying position when the medium is conveyed between the drive roller and the driven roller, the drive roller includes a drive body portion having a cylindrical shape, and a drive contact portion having a cylindrical shape, which is formed of a material having a smaller friction coefficient or a higher surface hardness than the drive body portion, is arranged coaxially with the drive body portion, and is formed with a groove portion along a circumferential direction, the driven roller includes a driven contact portion having a disk shape, which comes into contact with a portion of the drive contact portion excluding the groove portion at the non-conveying position, and a plurality of protrusion portions which are arranged in a circumferential direction of the driven contact portion with intervals provided therebetween, protrude outwardly in a radial direction, and are arranged in the groove portion while being set apart from a bottom surface of the groove portion at the non-conveying position, the drive contact portion is formed with a pair of guide portions which guide, to the groove portion, the protrusion portions of the driven roller moving from the conveying position to the non-conveying position, the pair of guide portions are formed by chamfering a pair of edge portions of the groove portion on an outer circumferential surface side, and the drive contact portion is formed to have a smaller diameter than the drive body portion, and forms a step portion that is concave with respect to the drive body portion.

2. The medium conveying apparatus according to claim 1, wherein the drive body portion is formed with a pair of second guide portions which guide, to the step portion, the driven contact portion of the driven roller moving from the conveying position to the non-conveying position, and the pair of second guide portions are formed by chamfering a pair of edge portions of the step portion on the outer circumferential surface side.

3. The medium conveying apparatus according to claim 1, wherein the driven roller, the drive body portion, and the drive contact portion are provided plurally, and the plurality of drive body portions and the plurality of drive contact portions are arranged coaxially with one another.

4. An image forming apparatus, comprising:

the medium conveying apparatus according to claim 1.

* * * * *